United States Patent [19]

Paul, Jr.

[11] Patent Number: 5,066,433

[45] Date of Patent: Nov. 19, 1991

[54] METHOD OF MANUFACTURING CARBON FIBER USING PRELIMINARY STRETCH

[75] Inventor: James T. Paul, Jr., New Castle County, Del.

[73] Assignee: Hercules Incorporated, Wilmington, Del.

[21] Appl. No.: 366,393

[22] Filed: Jun. 15, 1989

Related U.S. Application Data

[63] Continuation-in-part of Ser. No. 156,389, Feb. 16, 1988, abandoned.

[51] Int. Cl.[5] ..... D01F 9/22

[52] U.S. Cl. ..... 264/29.2; 264/29.7; 264/83; 264/210.7; 264/210.8; 264/211.15; 264/211.17

[58] Field of Search ..... 264/29.2, 29.7, 83, 264/210.7, 210.8, 211.15, 211.17

[56] References Cited

U.S. PATENT DOCUMENTS

| | | | |
|---|---|---|---|
| 4,001,382 | 1/1977 | Matsumura et al. | 423/447.1 |
| 4,009,248 | 2/1977 | Kishimoto et al. | 423/447.4 |
| 4,100,004 | 7/1978 | Moss et al. | 156/60 |
| 4,113,847 | 9/1978 | Fukushima et al. | 423/447.4 |
| 4,397,831 | 8/1983 | Saito et al. | 423/447.6 |
| 4,448,740 | 5/1984 | Sawanishi et al. | 264/182 |
| 4,452,860 | 6/1984 | Obama et al. | 428/367 |
| 4,695,415 | 9/1987 | Setsui et al. | 264/29.2 |

FOREIGN PATENT DOCUMENTS

| | | | |
|---|---|---|---|
| 0223199 | 5/1987 | European Pat. Off. | 264/29.2 |
| 53-24427 | 3/1978 | Japan . | |
| 55-163217 | 12/1980 | Japan | 264/29.2 |
| 59272341 | 7/1986 | Japan . | |
| 62-125017 | 6/1987 | Japan | 264/29.2 |
| 63-275716 | 11/1988 | Japan | 264/29.2 |
| 63-275718 | 11/1988 | Japan | 264/29.2 |
| 1324772 | 7/1973 | United Kingdom . | |

*Primary Examiner*—Hubert C. Lorin
*Attorney, Agent, or Firm*—David Edwards

[57] ABSTRACT

Process of carbon fiber manufacture wherein the polyacrylonitrile precursor is stretched prior to oxidation step of the carbonization operation but after the stretching step of the spinning operation in limited temperature range. Process permits greater throughput in precursor manufacture and reduces flaws in the precursor because significant stretching is at lower line speeds typically used for oxidation and carbonization in making carbon fiber.

8 Claims, 5 Drawing Sheets

METHOD OF MANUFACTURING CARBON FIBER USING PRELIMINARY STRETCH

This is a continuation-in-part of application Ser. No. 07/156,389 filed Feb. 16, 1988, now abandoned.

This invention relates to improvements in the manufacture of carbon fiber from acrylonitrile polymers. This invention, more particularly, relates to producing high quality and performance carbon fiber at significant cost savings through enhancing throughputs of precursor materials used in making such carbon fiber. This invention, still more particularly, relates to the discovery and exploitation of a limited temperature range wherein a multitude of filaments of the acrylonitrile polymer, such multitude often called "carbon fiber (polyacrylonitrile) precursor" or "precursor" for short, may be safely stretched up to four or more times its original length after formation but prior to the oxidation used in making the carbon fiber.

PAN-based carbon fiber (for purposes of describing this invention hereafter called "carbon fiber") is a well-known material that is over 85% by weight elemental carbon. Such carbon fiber is notable for enabling manufacture of light weight composite materials and other articles of manufacture of exceptional tensile strength and modulus.

Increased usage coupled with incremental improvements in the processes which manufacture carbon fiber have dramatically reduced its cost compared to when it was first introduced several years ago. Moreover, the attractiveness of light weight structures comprising carbon fiber has increased significantly due to recent marked improvements in the material properties of the carbon fiber and resin materials used in making the structures.

Of late, however, despite even wider potential usage of carbon fiber through advances in material properties, continued significant decreases in its price, at one time dramatic and routine, have not proceeded as expected. One reason is that reliable manufacture of high quality carbon fiber remains an art; skillful control of process conditions used in making it and repeated testing for assuring quality remain a manufacturing requisite. Furthermore, recent advances in material property performance have been achieved through use of finer denier precursor, i.e., small diameter filaments, and such finer denier precursor requires the same or greater amount of precursor process control in making it but at generally lower throughputs. Accordingly, while the processing quality and performance characteristics of carbon fiber have been maintained and even improved over the years, the cost of making such high quality carbon fiber has not been reduced to the degree possibly anticipated, particularly with respect to newer carbon fibers made with finer denier precursor.

It is evident that increases in the line speeds of the precursor and carbon fiber manufacturing processes reduce cost per weight of the final carbon fiber. However, further increases in line speeds, especially in precursor manufacturing speeds, increase the risk of lowering the quality of the resultant carbon fiber, particularly since precursor line speeds have generally approached their maximum limits with conventional equipment.

The cost of making carbon fiber under current procedures can be divided into two categories. First, there is the cost of making the precursor, e.g. material costs of acrylonitrile, other monomers and solvent used in making the acrylonitrile polymer, costs associated with spinning the precursor, costs associated with treating the spun filaments such as stretching in cold and hot water and steam, and costs associated with process control and testing. Other costs in making carbon fiber include the costs of oxidizing and then carbonizing the precursor, costs associated with the process control of such oxidation and carbonization and testing costs. Since only about half by weight of the precursor becomes carbon fiber, it can be seen that reduction per pound of precursor manufacturing costs results in about twice that reduction per pound in carbon fiber.

Exemplary description of making precursors useful for producing carbon fiber appear in UK 1,324,772, U.S. Pat. Nos. 4,100,004; 4,001,382; 4,009,248; 4,113,847; 4,397,831; 4,448,740; 4,452,860 and Japanese Applications 53-24427 and 59-272341. These publications describe making precursors wherein polyacrylonitrile filaments are stretched in hot water, steam and air prior to oxidation. For example, in the "Example of Application 1" of Japanese Application 59-272341, wet spun polyacrylonitrile filaments are said to have been stretched over five (5) times over a hot water bath, washed and dried and then drawn 1.3 times at 170° C. using dry heat prior to oxidation. U.S. Pat. No. 4,104,004, on the other hand, discloses stretching up to 75% between 100° C. and 160° C., e.g. 130° C.

Now, in accordance with this invention, a limited temperature range has been discovered whereby the precursor may be stretched to four or more times its original length in air, steam or other fluid medium. As a result, greater throughput of precursor can be achieved under the same process control procedures used at less than half the throughputs while at the same time, only marginally increasing the cost of producing carbon fiber through such stretching. Furthermore, since the stretching achieved in this limited temperature range can be quite high, certain stretching during manufacture of the precursor may be reduced or even eliminated thereby allowing still further increases in throughputs and reductions in precursor manufacturing costs.

This invention, more specifically, relates to an improvement in the process of manufacturing carbon fiber from polyacrylonitrile, the process comprising a) subjecting to a spinning operation a viscous solution of an acrylonitrile copolymer of acrylonitrile monomer with at least one ethenic monomer comprising extruding said solution through a die to form a multitude of continuous filaments and stretching said filaments in cold water, hot water, steam, or a combination thereof to at least twice the original length of the filaments and b) subjecting said stretched filaments to a carbonization operation comprising oxidizing said stretched filaments of the spinning operation at a temperature range of 180° to 300° C. in an oxidizing atmosphere in a series of ovens and carbonizing the oxidized filaments in progressively increasing temperature zones at temperatures from 400° to 2800° C. in a series of furnaces so that tar is removed in the first temperature zone, the improvement comprising i) selecting a precursor being capable of being stretched prior to the carbonization operation at a limited temperature range of from about 140° C. to about 180° C. in air in which range less than 1% based on kinetic calculations of oxidation occurs, ii) heating said precursor prior to the oxidizing step of the carbonizing operation but after the stretching step of the spinning operation to the limited temperature range of about 140° C. to about 180° C., and iii) while in said limited temperature range, stretching said precursor again to at least 1.5 times its previously stretched length performed in the spinning operation.

Moreover, after the polyacrylonitrile is extruded through the die, stretching prior to oxidation preferably consists essentially of stretching in the limited temperature range preceded by stretching at temperatures below boiling water temperature. Also, such stretching prior to stretching in the limited temperature range preferably comprises stretching under circumstances that plasticize the filaments.

Figure 1:
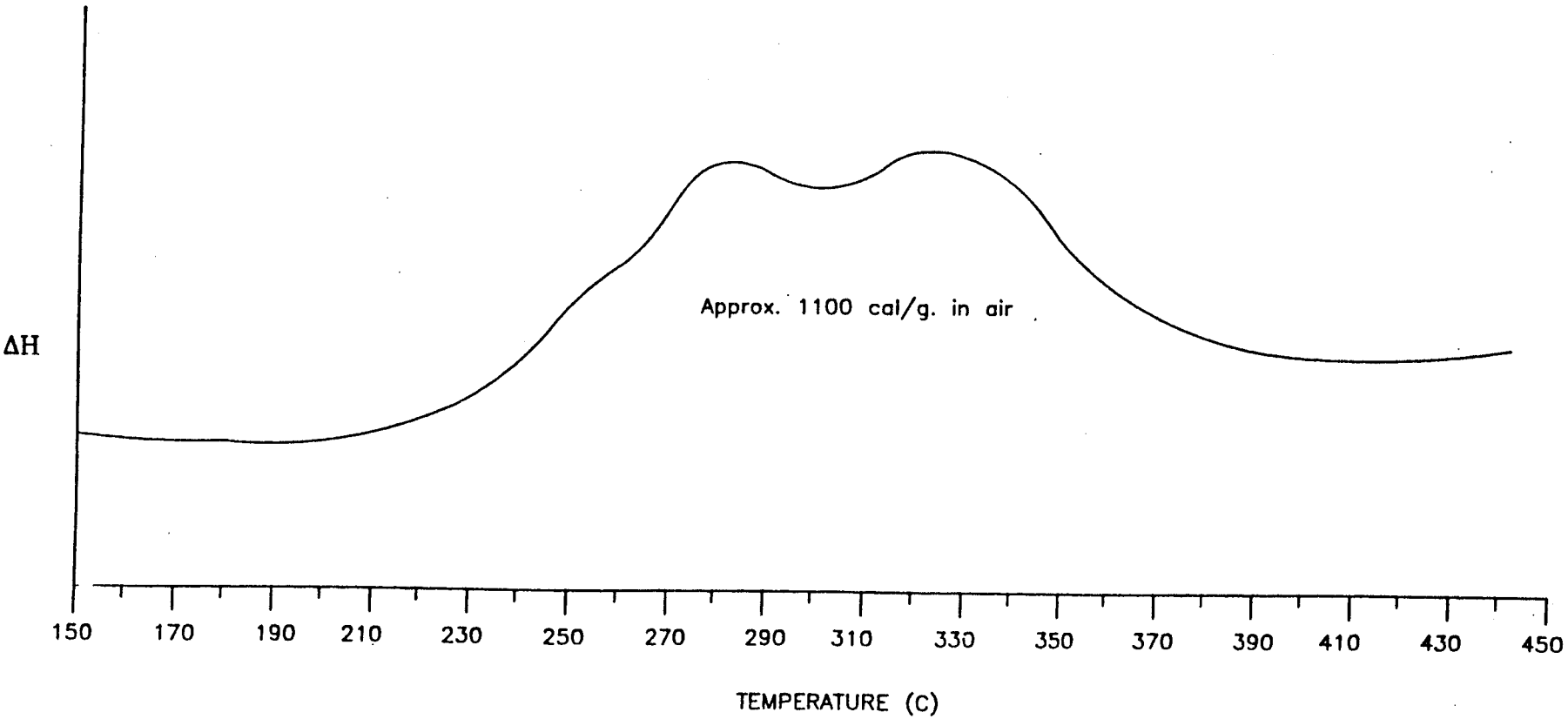
FIG. 1 illustrates the thermal response curve for a preferred precursor of this invention.

The polyacrylonitrile precursor useful in making carbon fiber in accordance with this invention comprises a polymer made by addition polymerization, either in solution or otherwise, of ethenic monomers (i.e. monomers that are ethylinically unsaturated), at least about 80 mole percent of which comprise acrylonitrile. The preferred acrylonitrile precursor polymers are copolymers of acrylonitrile and one or more other monofunctional ethenic monomers. Available ethenic monomers are diverse and include, for example, acrylates and methacrylates; unsaturated ketones; and acrylic and methacrylic acid, maleic acid, itaconic acid and their salts. Preferred comonomers comprise acrylic or methacrylic acids or their salts, and the preferred molar amounts of the comonomer ranges between about 1.5 and 3.5%. (See U.S. Pat. No. 4,001,382 and U.S. Pat. No. 4,397,831 which are hereby incorporated herein by reference.)

The acrylonitrile precursor polymers suitable for making carbon fiber hereof are soluble in organic and/or inorganic solvents such as dimethylsulfoxide, dimethyl formamide, zinc chloride or sodium thiocyanate solutions. In a preferred practice of making a polyacrylonitrile precursor for use in making the carbon fibers hereof, a solution is formed from water, acrylonitrile polymer and sodium thiocyanate at exemplary respective weight ratios of about 60:10:30. This solution is concentrated through evaporation and filtered to provide a spinning solution. The spinning solution preferably comprises about 15% by weight of the acrylonitrile polymer.

The spinning solution is passed through spinnerets using dry, dry/wet or wet spinning to form the polyacrylonitrile precursor. The preferred polyacrylonitrile precursor is made using a dry/wet spinning wherein a multitude of filaments are formed from the spinning solution and pass from the spinneret through an air gap or other gap between the spinneret and a coagulant preferably comprising aqueous sodium thiocyanate. After exiting from the coagulant bath, the spun filaments are washed and then stretched again to several times their original length in hot water and steam. (See U.S. Pat. No. 4,452,860 herein incorporated by reference and Japanese Application 53-24427 [1978].) In addition, the polyacrylonitrile precursor is treated with sizing agents such as silane compounds (see U.S. Pat. No. 4,009,248 incorporated herein by reference).

The polyacrylonitrile precursor (preferably silane sized) is in the form of tows in bundles comprising a multitude of filaments (e.g. 1,000, 10,000 or more). The tows or bundles may be a combination of two or more tows or bundles, each formed in a separate spinning operation.

The polyacrylonitride precursor of this invention has to be capable of being stretched prior to a carbonization operation at a limited temperature range of from about 140° C. to about 180° C. in air in which range less than 1% based on kinetic calculations of oxidation occurs. The less than one percent of oxidation is based on kinetic calculations of heat evolved on heating the fibers in air (i.e., heat of reaction, ΔHd, calories per gram) under the following conditions:

Apparatus:
- Instrument — Du Pont 990 Thermal Analyzer and Cell Base
- Chart Paper — Du Pont (Part No. 990089)
- Sample Pans — Perkin Elmer Aluminum (Kit no. 219-0041)
- Sealer — Perkin-Elmer Crimping Press (kit no. 219-0061)
- Temp Std — Indium
- Gas — $N_2$
- Thermocouple — Chromel/Aumel
- Cooling Accessory — Du Pont Liquid $N_2$ Cooling Accessory (Cat. No. 990285-901)
- Spex Freezer Mill — Spex Industries Inc. Metuchin, N.J. Cat. No. 6700

Conditions:
- Atmosphere — Air
- Flow Rate — 70 cc./min.
- Heating Rate — 10° C./min.
- Time Base — 2 min./in.
- Sensitivity — 0.5 (mcal./sec.)/inch
- Wt. of Sample — 1.7-1.9 mg.
- Temp. Range 20°-400° C.

A thermal response curve in air of a preferred polyacrylonitrile precursor suitable for use in making the carbon fibers of this invention is shown in FIG. 1. This precursor is made from a monomer composition comprising about ninety eight mole percent (98%) acrylonitrile and about two mole percent (2%) methacrylic acid.

The denier per filament of the polyacrylonitrile precursors desirably ranges between 0.6 and 6.0 or higher. The particular denier of the polyacrylonitrile precursor chosen influences subsequent processing of the precursor into carbon fiber hereof. For example, larger denier precursor, e.g. 1.33 denier per filament or above precursor is preferably stretched at temperatures below 200° C. (e.g. about 150°-160° C.) to reduce its denier to less than 0.8 prior to significant oxidation. Greater stretching in the limited temperature range reduces the need for such stretching in later, e.g., during oxidation, manufacturing steps in making the carbon fiber.

Through stretching at temperatures between 145° and 165° C., the resultant precursor is up to 4.0 times or more its original length; and due to the minimal reaction at temperatures within this range may be in amounts selectively calculated in advance to provide the denier desired for subsequent oxidation and stabilization. For example, a 2.2 denier per filament precursor may be stretched to twice its original length to yield a 1.1 denier per filament material by a Stretch Ratio (S.R.) of 2 according to the following formula:

$$d_n = \frac{ds}{S.R.} \text{ where } S.R. \text{ equals } \frac{Lo}{Li}$$

where $L_o$ is length out, $L_i$ is length in (i.e. original length), $d_s$ is original denier and $d_N$ is new denier. Desired stretch ratio (S.R.) may be achieved by drawing the precursor faster through the desired heated zone (e.g. temperature between 150° C. and 160° C.) that it is permitted to enter this zone.

Figure 2:
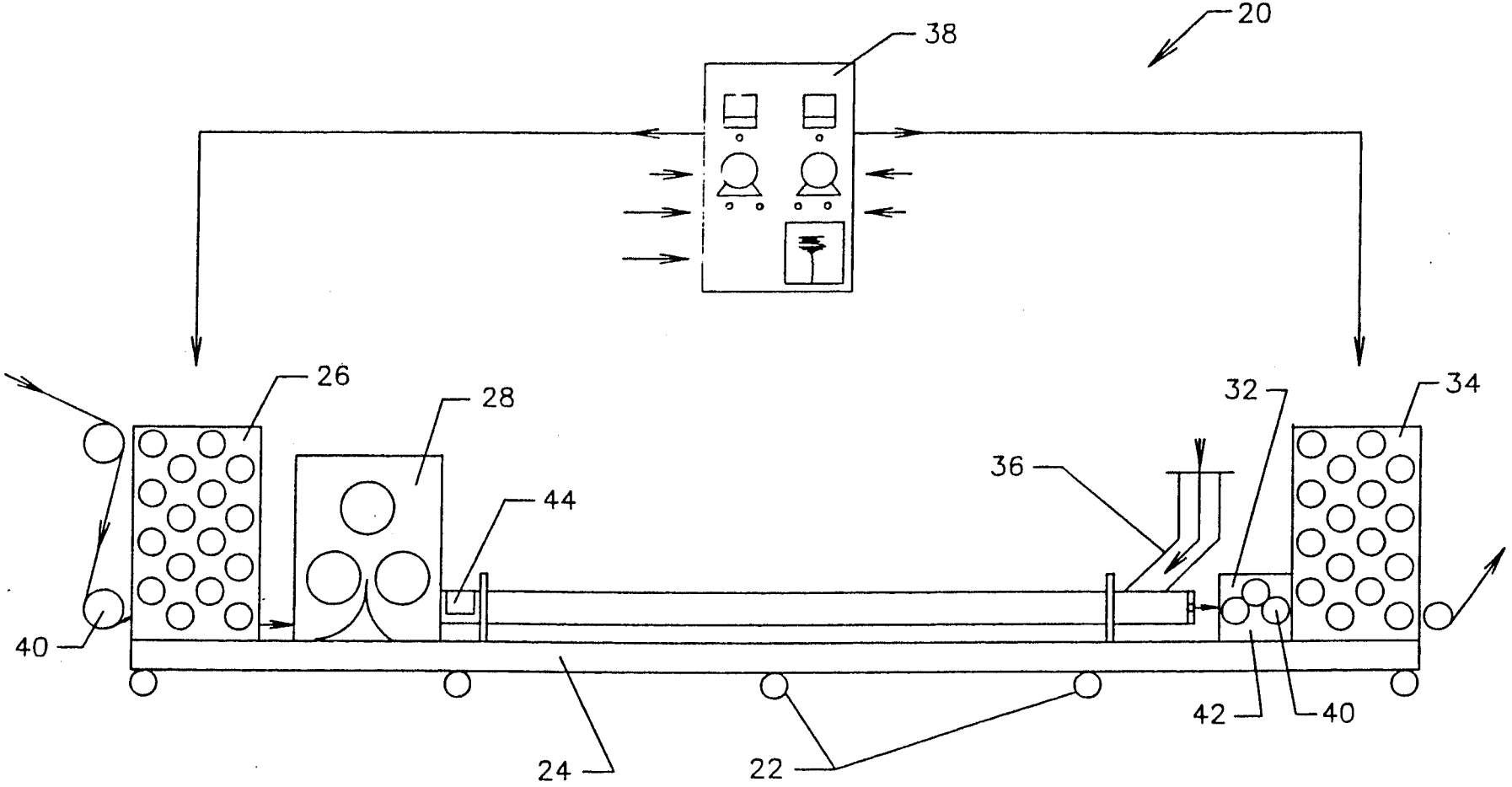
FIG. 2 illustrates diagrammatically a device that is useful in practice of this invention.

FIG. 2 illustrates in schematic form the design of stretching device 20 useful in practice of this invention. Device 20 of FIG. 2 comprises supports 22 which carry platform 24 on which inlet roll stack 26, steam heated roll 25 stack 28, steam heated tube 30 and outlet roll stacks 32 and 34 are mounted.

Steam heated tube 30 is heated by steam passing through a jacket surrounding the tube walls. In addition, gas inlet tube 36 is mounted to the downstream end of steam heated tube 30 and provides for entry of heated air or other gas when countercurrent gas heating is used in heat-up of the precursor traveling between about inlet and outlet roll stacks 26, 34. Control 38 monitors inlet and outlet counter-rolls 40, 42 which can also measure tension and line speed as read out in control 38. Access port 44 permits stringing precursor through steam heated roll stack 28.

Steam heated roll stack 28 is optionally used in providing preliminary heat transfer to the precursor as it travels around the steam heated rolls 28. This preliminary heat transfer permits shorter heated lengths of steam heated tube 30, if desired.

Features of the Device 20 of FIG. 2 such as length of steam heated tube 30, use or non-use of steam heated roll stack 28 and gas flow velocity, direction and placement of inlet tube 36 as well as temperatures used for heating thereof are selected as a matter of design choice so as to provide rapid heat-up of the precursor as well as compatibility with the oxidation and carbonization line speeds in the carbon fiber process. Initial tow spacing that ranges Preferably between about 2 and 4.5 tows per 2.54 centimeter for 12,000 filament tows are preferred for flow of heat transfer medium, such spacing advantageously inherently increasing as stretching proceeds.

The polyacrylonitrile precursor after stretching in the limited temperature range according to this invention, is oxidized in one or more ovens preferably maintained at temperatures between 180° C. and 300° C. A variety of oven geometries are known to provide appropriate oxidation in making carbon fiber and any of these ovens may be suitably employed in accordance with this invention. Preferably, however, a series of ovens (or series of passes through a single oven) are employed according to this invention with the precursor that is undergoing oxidation optionally stretched to a longer length than the length it has upon entering the oxidation oven. After exit from the oxidation oven or ovens, the oxidized (and stabilized) precursor is passed to one or more furnaces for carbonization in an inert atmosphere. Preferably, at least two furnaces are employed respectively at temperatures between 400° C. and 800° c. and between 1000° C. and 1400° C. Still higher modulus carbon fiber is made through using still another furnace having temperatures above 1800° C., e.g. between 2000° C. and 2800° C. The fiber undergoing carbonization is desirably stretched or at least not allowed to shrink in the temperature range between 400° C. and 800° C. and 2000° C. and 2800° C.

After exit from the high temperature furnace the carbonized fiber is surface treated. A variety of surface treatments are known in the art. Preferred surface treatment is an electrolytic surface treatment and the degree of surface treatment is ordinarily a function of the carbonization temperatures used in making the fiber. The preferred electrolytic surface treatment comprises passing the fiber through a bath containing an aqueous ammonium bicarbonate or sodium hydroxide solution (e.g. 0.5–3% by weight). The current is applied to the fiber at between about 0.1 and 5 columbs/inch of fiber per 12,000 filaments. The resulting surface treated fiber is then preferably sized with an epoxy compatible sizing agent such as Shell epoxy Epon 834.

The following examples are intended to illustrate this invention and not to limit its broader scope as set forth in the appended claims. In these examples, all temperatures are in degrees Centigrade and all parts are parts by weight unless otherwise noted.

EXAMPLE 1

Polyacrylonitrile precursors were made using an air gap wet spinning process. The polymer of the precursor had an intrinsic viscosity between about 1.9 and 2.1 deciliters per gram using a concentrated sodium thiocyanate solution as the solvent. The spinning solution and coagulants comprised an aqueous solution of sodium thiocyanate. The polymer was made from a monomer composition that was about 98 mole % acrylonitrile and 2 mole % methacrylic acid. The precursors were stretched so that their length in tow form was about six times greater after steam stretching compared to their length after extrusion from the spinnerets. Table A shows the characteristics of the resulting precursor which were nominal 1.3 and 0.8 dpf (denier per filament).

TABLE A

| | Precursor Properties | |
|---|---|---|
| DPF (NOMINAL) | 1.3 | 0.8 |
| Precursor Properties | | |
| Tow Denier (g/9000m) | 16,053 | 9,570 |
| Tow Tenacity (g/d) | 4.9 | 5.6 |
| Tow Modulus (g/d) | 96 | 102 |
| DHT (g/d) | 0.142 | 0.166 |
| Boil-off Shrinkage (%) | 5.5 | 5.7 |
| US Content (%) | 0.60 | 0.88 |
| Sodium Content (ppm) | 580 | 568 |
| Residual Solvent (%) | — | 0.0073 |
| Moisture Content (%) | 0.92 | 0.60 |
| Filament Diameter Cv (%) | 4.1 | 4.4 |
| Monster Filaments | 0 | 0 |

The precursors were then stretched at a temperature of 158° with a residence time of about six (6) minutes at that temperature. After stretching, the stretched precursor was oxidized in stages generally at 234° C. and then 249° C. The oxidized fiber was then passed through a low temperature furnace with a non-oxidizing atmosphere (nitrogen) at a temperature between 600° C. and 800° C. (tar removal) and then passed to a high-temperature furnace having a temperature between 1200° C. and 1400° c. and non-oxidizing atmosphere (nitrogen). During passage through the low and high temperature furnaces the fiber undergoing carbonization in these furnaces was either allowed to shrink or was stretched across the length of the furnaces.

Tables B and C, set forth below, show the stretch of the fiber undergoing carbonization as it passes through the tar removal (TR) and high temperature (C1) furnaces along with the calculated dpf of the filament based on the stretch imparted at 158° C. Under each level of stretch in these tables the tensile strength and modulus properties are listed for the fiber having the calculated dpf and stretch during passage through the TR and C1 furnaces. (Tables B and C show results from using the 1.3 dpf precursor of Table A; Table D shows the result of using the 0.8 dpf precursor of Table A.) The first value in columns 4 through 9 of Table A is tensile strength of the resultant carbon fiber in psi times 1000 and the second value is modulus in psi times 1,000,000. Modulus and tensile strength measurements were made using strand and tow test (Impregnated Strand) procedures.

TABLE B

| Run No. | Calc. Denier | Stretch Ratio | (1.33 dpf) TR/C1 STRETCH −4% | 0% | 2½% | 5% | 7½% | 10% | 12% |
|---|---|---|---|---|---|---|---|---|---|
| 93 | 1.21 | 1.1 | 501/39.2 | 537/39.8 | 569/39.5 | | | | |
| | | | | 594/40.6 | 508/38.5 | 500/37.8 | 482/40.5 | 486/39.2 | 487/40.9 |
| 97 | 1.21 | 1.1 | 484/36.2 | 500/36.4 | 501/38.0 | 470/36/9 | 492/38.7 | 462/37.4 | — |
| 99 | 1.02 | 1.3 | 511/38.6 | 519/39.3 | 563/39.9 | 575/40.0 | 593/41.2 | 576/41.5 | 549/42.0 |
| 101 | 0.95 | 1.4 | 549/39.5 | 567/40.0 | 538/40.0 | 557/42.2 | 574/40.3 | 565/42.3 | 567/43.2 |
| 103 | 0.89 | 1.5 | 570/39.2 | 593/41.7 | 610/41.5 | 641/41.5 | 640/42.8 | 607/43.0 | 573/37.7 |
| 105 | 0.83 | 1.6 | 568/39.9 | 575/41.2 | 548/39.9 | 515/39.4 | 557/40.3 | 546/43.7 | 637/42.6 |
| 107 | 0.78 | 1.7 | 542/40.6 | 570/37.9 | 564/39.0 | 580/41.5 | 621/42/8 | 613/42.0 | 592/41.6 |

TABLE C

| Run No. | | Calc. Denier | Stretch Ratio | (0.8 dpf) TR/C1 STRETCH −4% | 0% | 2½% | 5% | 7½% | 10% |
|---|---|---|---|---|---|---|---|---|---|
| 53 | (control) | 0.68 | 1.17 | 657/39.9 | 659/39.9 | 639/40.8 | 671/41.6 | — | — |
| 55 | | 0.62 | 1.30 | 602/39.1 | 765/41.5 | 698/41.3 | 756/43.3 | 738/43.6 | — |
| 59 | | 0.53 | 1.50 | 686/41.3 | 694/42.4 | 737/45.6 | 733/43.5 | — | — |
| | | | | | | | 639/41.0 | 497/40.2 | — |
| 67 | | 0.62 | 1.30 | 604/39.3 | 624/40.8 | 679/42.2 | 711/43/2 | — | — |
| 71 | | 0.53 | 1.50 | 690/42.0 | 704/42.2 | 746/43.2 | 729/41.9 | — | — |

EXAMPLE 2

Polyacrylonitrile precursor was made generally according to the conditions previously described except that it had no steam stretching and its denier was 1.2 dpf. The 1.2 dpf polyacrylonitrile precursor fiber was stretched to twice its original length (i.e. s. r. equals 2) at a temperature of 158° C. and wound around a spool and stored.

The precursor was then oxidized by passing it through air circulation ovens at temperatures for the times shown in the following Table D.

TABLE D

| Temperatures | Time (minutes) |
|---|---|
| 158° C. | 2.05 |
| 240° C. | 17.73 |
| 245° C. | 14.43 |
| 248° C. | 17.72 |
| 250° C. | 17.72 |
| 250° C. | 4.43 |

The oxidized precursor passed from the last oxidation oven through a low temperature (tar removal) furnace. Then the partially carbonized fiber passed through a first low temperature furnace held at 1425° C. and then a second high temperature furnace held at 2500° C.

The stretch in each of the low temperature, first high and second high temperature furnaces are shown below (values are %) for four distinct runs in Table E below.

TABLE E

| Run | Overall | TR | C1 | C2 |
|---|---|---|---|---|
| 135-1 | 0.1 | 4.5 | −5.3 | 0.9 |
| 135-2 | 2.4 | 6.9 | −5.1 | 0.9 |
| 135-3 | 4.9 | 9.3 | −5.0 | 1.0 |
| 135-4 | 6.9 | 11.3 | −4.1 | 0.2 |

Table F, below, shows the properties of carbon fiber made according to the procedures of this Example.

TABLE F

| Run | Modulus[a] | Tensile Strength[b] |
|---|---|---|
| 135.1 | 58.2 | 606 |
| 135.2 | 60.1 | 615 |
| 135-3 | 61.5 | 628 |
| 135-4 | 61.4 | 558 |

[a] $10^6$ psi
[b] $10^3$ psi

EXAMPLE 3

In this Example, precursor was made under conditions generally described heretofore. The precursor had a 1.67 dpf (12,000 filaments per tow) and had not been stretched under steam. The precursor was passed through a device like that shown in FIG. 2 and stretched four (4) times its original length (i.e. S.R. equals 4) after a residence of 0.8 minutes at about 158° C. In similar studies, a precursor run at the same temperature but at a residence time of 0.25 minutes broke prior to achieving a stretch that was equivalent to making it 2.3 times longer than its original length. When the residence time was increased to 0.33 minutes at 158° C., the tows broke unacceptably after a stretch that made them 3.3 their original length. However, the precursor had reduced cosmetics at stretch ratios (S.R.) which equaled 2.0 and 2.3 at these respective 0.25 minutes and 0.33 minutes residences at 158° C.

EXAMPLE 4

In this Example the precursor used was made from a polyacrylonitrile polymer using sodium thiocyanate as solvent and coagulant and an air gap spinning process, as described heretofore. The fiber was only stretched in water and had a 2.67 dpf and 12,000 filaments per tow. Methacrylic acid was used in making the polyacrylonitrile polymer.

The 2.67 dpf precursor was stretched in a prototype device like that shown in FIG. 2, also described hereinbefore. Hot air at 158° C. was circulated in countercurrent flow in tube 30 around the tows which were spaced about 1.8 tows per centimeter. Steam at 71 psig was passed into the jacket of tube 30 and into the rolls of roll stack 28. The line speed was gradually increased with the stretch ratio held at 3.9 (i.e. precursor was 3.9 times as long after stretching as compared to length prior to stretching). Tensions of the precursor were measured in the rolls stacks 26, 34.

Results of this Example are shown in Table G, below.

TABLE G

Effect of Increasing Speed on Break Stretch Ratio

| Stretch Ratio | Line Speed | No. of Tows | Tension (gpd) at Pin Position 1 | 4 | 10 |
|---|---|---|---|---|---|
| 3.9X | 25 ft/min. | 10 | 0.347 | 0.335 | 0.333 |
| 3.9X | 25.8 | 10 | 0.347 | 0.335 | 0.333 |
| 3.9X | 26.6 | 10 | 0.347 | 0.335 | 0.333 |
| 3.9X | 27.5 | 10 | 0.347 | 0.335 | 0.333 |
| 3.9X | 28.3 | 10 | 0.349 | 0.335 | 0.335 |
| 3.9X | 29.1 | 10 | 0.349 | 0.335 | 0.335 |
| 3.9X | 30.0 | 10 | 0.349 | 0.335 | 0.335 |

Fiber broke during 30 ft/min. run.
Run used 2.67 dpf/12K precursor, hot air at 158° C., steam tube and rolls at 71 psig.

Table H below shows the results of making a nominal 0.8 dpf precursor from the aforedescribed 2.67 precursor described above using the procedures of this invention.

TABLE H

| Run No. | No. of Tows | Band Width of Tows | Output Line Speed | Stretch Ratio | Tension (gpd) at Pin No. 1 | 4 | 10 |
|---|---|---|---|---|---|---|---|
| 77 | 10 | 1.8 tows/cm | 25 ft/min. | 3.34X | 0.344 | 0.323 | 0.321 |
| 87 | 10 | 1.8 cm | 25 | 3.34X | 0.332 | 0.325 | 0.326 |

Hot air at 158° C., steam tube and rolls at 72 psig. 2.67 dpf/12K precursor.

A standard steam stretched precursor (See Table A) having a 0.8 dpf was used as a control in making carbon fiber and compared against carbon fiber made from a 0.8 dpf (calculated) precursor which was made using the procedures of this invention. The results are shown in Table I below. As can be seen, nearly equivalent properties are obtained using the procedures of this invention even though the amount of stretching in oxidation is less.

TABLE I

| Run No. | Fiber Type | Stretch | Carb.[3] | Carbon Fiber Properties T.S. Msi | Mod. MMsi | Density g/cc | W/L g/ft |
|---|---|---|---|---|---|---|---|
| 79-1Z[1] | Std. 0.8 dpf/12K | 1.17X | 1.0X | 678 | 41.4/38.2 | 1.779 | 0.1399 |
| 79-2[1] | Std. 0.8 dpf/12K | 1.17X | 1.025X | 654 | 42.9/39.8 | 1.793 | 0.1359 |
| 79-3[1] | Std. 0.8 dpf/12K | 1.17X | 1.05X | 658 | 43.2/39.9 | 1.778 | 0.1321 |
| 79-4[1] | Std. 0.8 dpf/12K | 1.17X | 1.075X | 660 | 42.2/39.4 | 1.782 | 0.1302 |
| 85-2[2] | Stretched 0.8 dpf/12K | 1.005X | 1.025X | 656 | 45.5/43.1 | 1.789 | 0.1501 |
| 85-3[2] | Stretched 0.8 dpf/12K | 1.005X | 1.05X | 612 | 41.9/39.8 | 1.797 | 0.1556 |
| 85-4[2] | Stretched 0.8 dpf/12K | 1.005X | 1.075X | 576 | 42.5/40.2 | 1.785 | 0.1503 |
| 89-1[2] | Stretched 0.8 dpf/12K | 1.005X | 1.0X | 624 | 45.8/43.9 | 1.778 | 0.1535 |
| 89-3[2] | Stretched 0.8 dpf/12K | 1.005X | 1.05X | 640 | 45.1/42.9 | 1.784 | 0.1522 |

C. Fiber processed[4]: oven 1 = 158° C.; oven 2 = 235° C.; oven 3 = 245° C. and oven 4 = 250°C.
[1]Control.
[2]The invention.
[3]"Carb." stands for carbonization.
[4]Four ovens at temperatures shown; low temperature furnace temperature between 600 and 800° C.; high temperature furnace at about 1350° C. Stretch recited for carbonization is stretch across high and low temperature furnaces.

EXAMPLE 5

Figure 3:
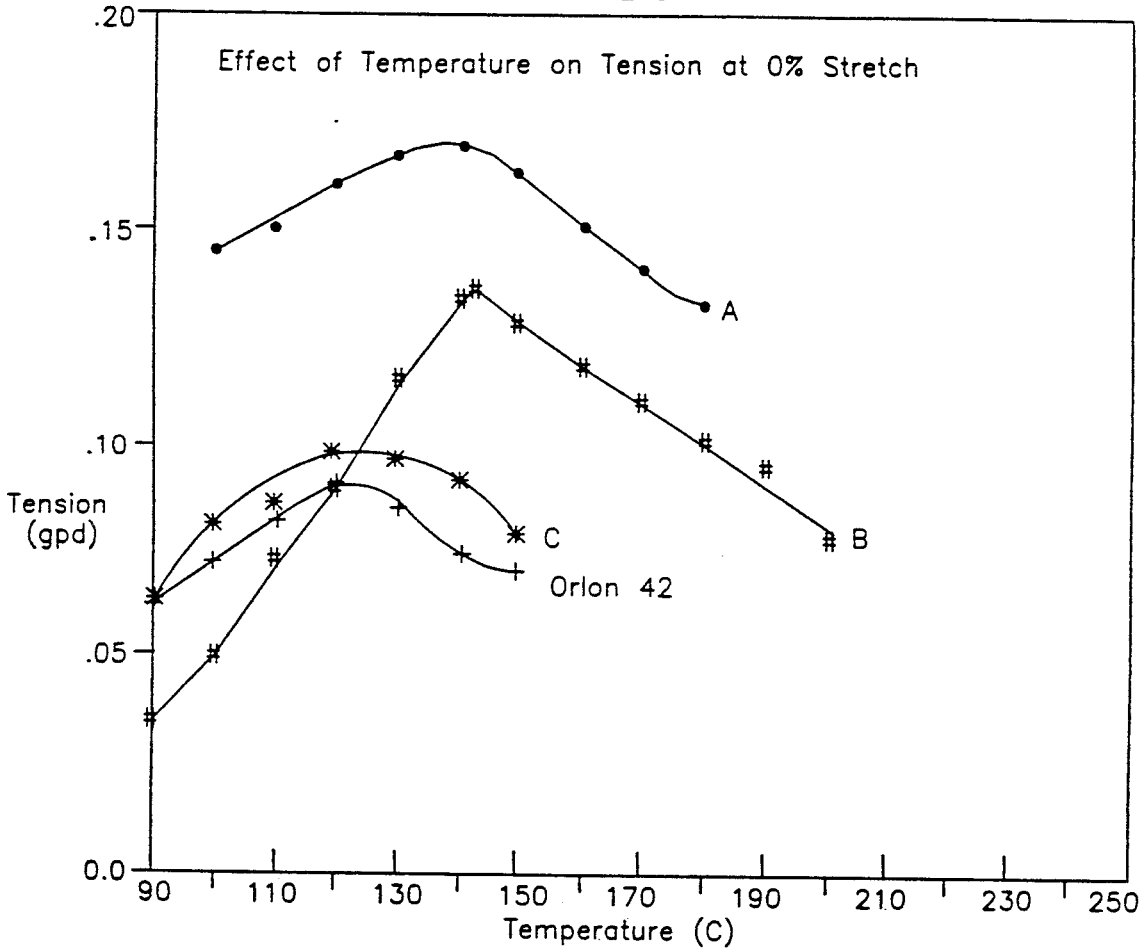
FIGS. 3, 4 and 5 illustrate properties of precursors heated to a temperature in a range useful for practice of this invention.

The tension developed at increasing temperatures and 0% stretch (i.e. constant length) for various precursors was measured. The tension measured versus the temperature to which each precursor was heated at this 0% stretch is shown in FIG. 3 for four polyacrylonitrile materials. The monomer composition for the precursor of Curve A in FIG. 3 included acrylonitrile, methacrylic acid and methylacrylate. The monomer composition used in making the precursor of Curve B in FIG. 3 included acrylonitrile and methacrylic acid. The monomer composition used in making the precursor of Curve C included acrylonitrile, itaconic acid and methylacrylate.

Figure 4:
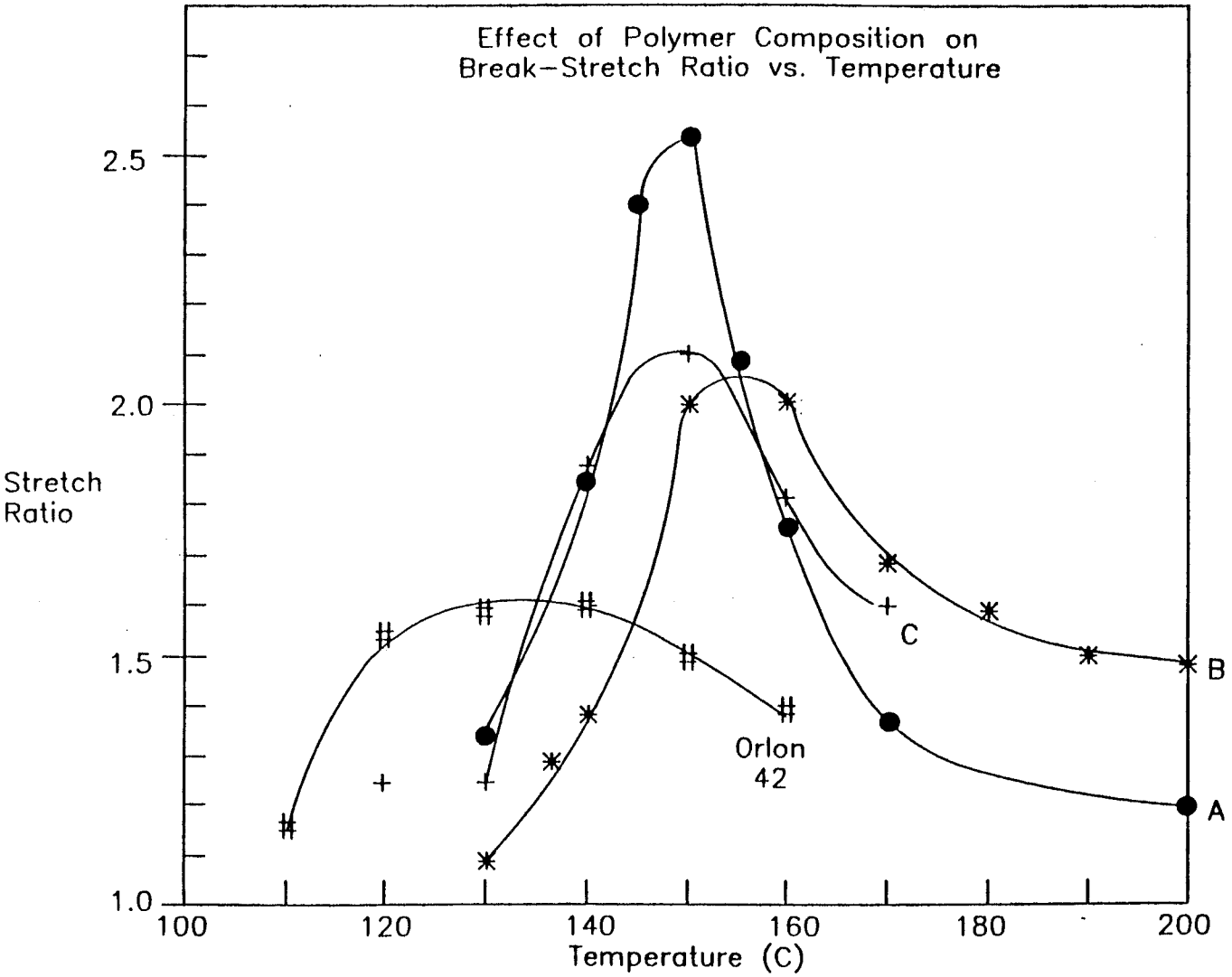

Precursors of various compositions were heated to various temperatures and the break stretch ratio (i.e. stretch ratio (SR) when the precursor filaments broke) determine for that temperature for each precursor composition. Curve A, FIG. 4, shows a plot of break stretch ratio, or stretch ratio at the time the filaments of the precursor broke, for a precursor made from ingredients noted above in connection with FIG. 3. Likewise, Curves B and C of FIG. 4 show results for precursors having compositions indicated above with respect to FIG. 3.

Figure 5:
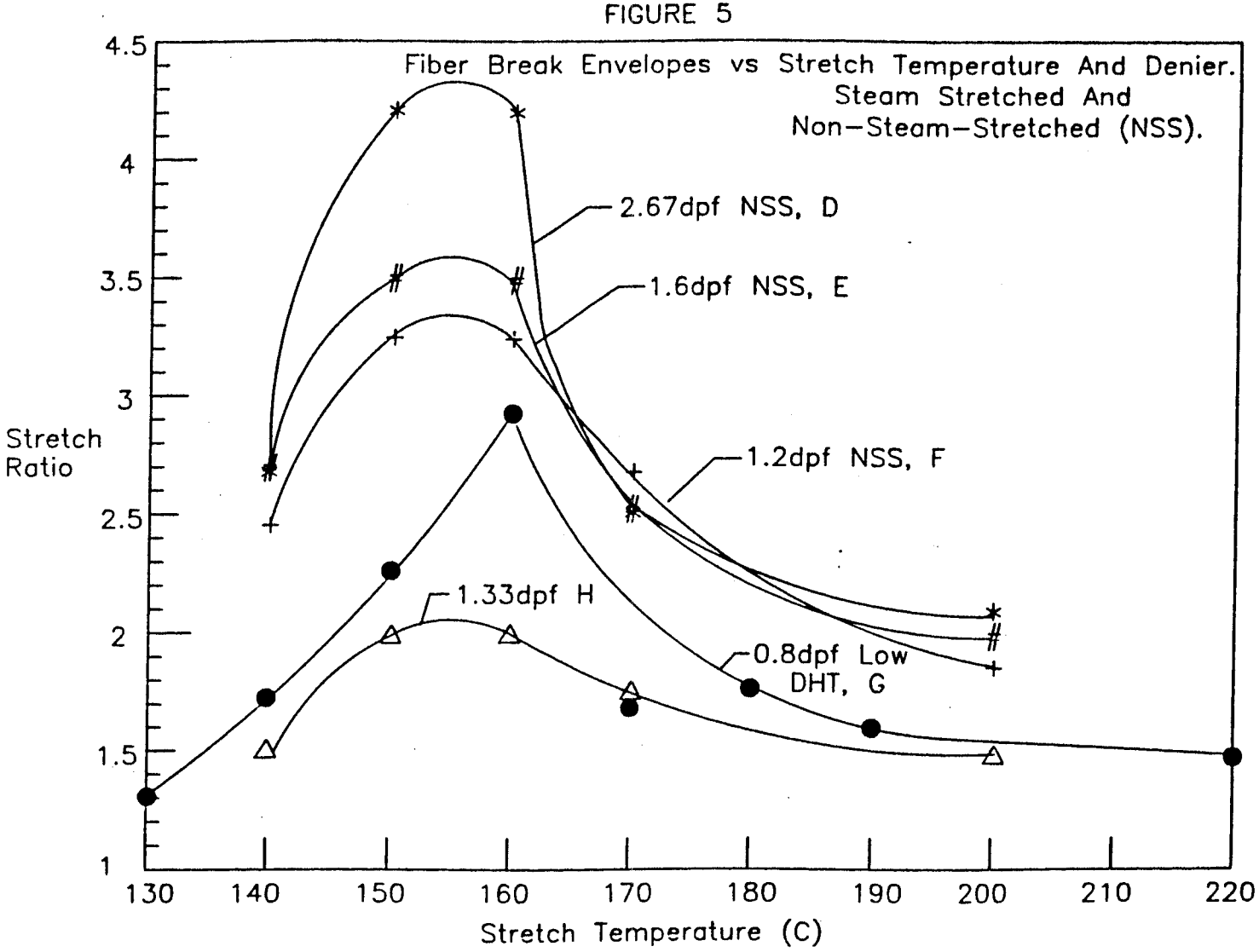

FIG. 5 shows the results of stretching different denier precursors until breaking at various temperatures. The monomer composition used in making each of the precursors in FIG. 5 was 98 mole % acrylonitrile and 2 mole % methacrylic acid. Precursors D, E and F were not stretched in steam and have therefore somewhat less previous stretch imparted than precursors G and H (which were steam stretched).

I claim:

1. In an improved process for manufacturing carbon fiber from polyacrylonitrile precursor comprising a) subjecting to a spinning operation a viscous solution of an acrylonitrile copolymer of acrylonitrile monomer with at least one ethylenic monomer comprising extruding said solution through a die to form a multitude of continuous filaments and stretching said filaments in cold water, hot water, steam, or a combination thereof to at least twice the original length of the filaments and b) subjecting said stretched filaments to a carbonization operation comprising oxidizing said stretched filaments of the spinning operation at a temperature range of 180° to 300° C. in an oxidizing atmosphere in a series of ovens and carbonizing the oxidized filaments in progressively increasing temperatures zones at temperatures from 400° to 2800° C. in a series of furnaces so that tar is removed in the first temperature zone, the improvement comprising i) selecting a precursor being capable of being stretched prior to the carbonization operation at a limited temperature range of from about 140° C. to about 180° C. in air in which range less than 1% based on kinetic calculations of oxidation occurs, ii) heating said precursor prior to the oxidizing step of the carbonizing operation but after the stretching step of the spinning operation to the limited temperature range of about 140° C. to about 180° C., and iii) while in said limited temperature range, stretching said precursor again to at least 1.5 times its previously stretched length performed in the spinning operation.

2. The process in accordance with claim 1, wherein said heating of step (iii) comprises heating in a gaseous medium.

3. The process in accordance with claim 1, wherein said heating of step (ii) comprises heating through contact with heated rollers.

4. The process in accordance with claim 1, wherein said limited temperature range is between about 150° C. and 160° C.

5. The process in accordance with claim 1, wherein said polyacrylonitrile is made from a monomer composition comprising about 98 mole % acrylonitrile and about 2 mole % methacrylic acid.

6. The process of claim 5 wherein the precursor is stretched in step (iii) in said limited temperature range at a temperature of 158° C.

7. The process in accordance with claim 1, wherein said precursor tow that is stretched in step (iii) is passed in a heated condition to an oxidation oven.

8. The process in accordance with claim 1, wherein said drawing of step a consists essentially of drawing at a temperature below 100° C.

* * * * *